US005272819A

United States Patent [19]

Wimberger et al.

[11] Patent Number: 5,272,819

[45] Date of Patent: Dec. 28, 1993

[54] MOVEABLE WEB SLOT

[75] Inventors: Richard J. Wimberger, DePere; Allan W. Rogne, Two Rivers, both of Wis.

[73] Assignee: W. R. Grace & Co.-Conn., New York, N.Y.

[21] Appl. No.: 701,263

[22] Filed: May 16, 1991

[51] Int. Cl.[5] ..... F26B 3/00

[52] U.S. Cl. ..... 34/23; 34/156; 34/242; 34/158

[58] Field of Search ..... 34/155, 156, 157, 158, 34/159, 160-163, 242, 23, 24, 28, 56

[56] References Cited

U.S. PATENT DOCUMENTS

| | | | |
|---|---|---|---|
| 2,590,849 | 4/1952 | Dungler | 34/156 |
| 2,775,046 | 12/1956 | Kabelitz | 34/156 |
| 3,927,540 | 12/1975 | Tanaka et al. | 34/242 |
| 3,971,235 | 7/1976 | Frezza | 34/158 |
| 4,043,157 | 8/1977 | Schiffer | 34/242 |
| 4,407,650 | 10/1983 | Greenler | 432/242 |
| 4,505,053 | 3/1985 | Andersson et al. | 34/155 |
| 4,520,750 | 6/1985 | Mansour | 118/58 |
| 4,575,952 | 3/1986 | Bodenan et al. | 34/54 |
| 4,606,137 | 8/1986 | Whipple | 34/156 |
| 4,767,042 | 8/1988 | Daane | 34/156 |
| 4,777,736 | 10/1988 | Van Oursouw et al. | 34/156 |
| 4,787,547 | 11/1988 | Hella et al. | 226/97 |

FOREIGN PATENT DOCUMENTS 758911 1/1951 United Kingdom .

*Primary Examiner*—Henry A. Bennet
*Assistant Examiner*—Denise L. Gromada
*Attorney, Agent, or Firm*—Kevin S. Lemack; William L. Baker

[57] ABSTRACT

Apparatus and method for reducing web slot infiltration in web floatation drying apparatus, including a moveable web slot assembly which moves according to the position of the running web in the dryer. In one embodiment, the dryer includes a web steering assembly which steers the web in a substantially straight sinusoidal path. The moveable web slot is in communication with the steering assembly so that the slot moves to accommodate the position of the steered web.

16 Claims, 9 Drawing Sheets

MOVEABLE WEB SLOT

BACKGROUND OF THE INVENTION

The present invention relates to the reduction of web slot infiltration which occurs during the drying of a web or the like in industrial drying apparatus.

In drying a moving web of paper, film, or the like, it is desirable that the web be contactlessly supported during the drying operation, to avoid damage to the web itself or to an ink or coating on the web. One common arrangement for contactlessly supporting a web comprises upper and lower sets of air bars extending along a substantially horizontal stretch of the web. Air issuing from the lower set of air bars floatingly supports the web. Air issuing from the upper set of air bars steadies the web to maintain it substantially straight and at a substantially constant distance from the air bars of both sets. The air blown from both sets of air bars is usually heated to expedite web drying, and typically the air bar array is inside an enclosure which is maintained at a slightly subatmospheric pressure by an exhaust blower that draws off the volatiles emanating from the web.

Web dryers are used in many printing and graphics applications, such as the processing of photographic film, web offset printing, and other types of printing. In some applications, such as the processing of photographic film, web dryers having very long lengths, often as long as 150 feet, are commonly used. The greater the ratio of the length of the dryer to the width of the web (hereinafter referred to as the "length to width ratio"), the more susceptible the web is to minor forces that can cause the web to weave (move back and forth in a lateral direction) or shift (move laterally from the centerline and remain there). Also, some webs, such as thin plastic films, naturally take on a "banana-shaped" curve when they are laid flat, as in a dryer, thereby exacerbating the problems of web weave and shift. Web shifting and weaving may also result when the web tension is low, and when a lighter weight web, such as polyester film, is used.

When the traveling web exits the drying apparatus it is generally wrapped around one or more rotating take-up members, such as chill rolls. When web weave or shift takes place as the web travels through the dryer, the web will correspondingly shift or weave as it contacts the rotating take-up member. Unless the web can be brought back to a straight orientation with respect to the centerline, the web will not fold properly and the press must be shut down. This results in costly downtime and waste.

Other problems may result from web weave or shift, e.g. if the web moves to one side or the other and stays in the new position it may not be centered on the press, resulting in an unacceptable product; if the web weave or shift is severe enough the web may break or tear, etc. These problems also force a shut-down of the press and thus a loss of valuable production time.

In the past, attempts have been made to circumvent web weave and shift by guiding the web using contact systems such as a series of rollers. These systems are undesirable as they may cause damage to the ink or coating on the web, and are therefore inefficient in situations where there is a high length to width ratio.

Co-pending U.S. patent application Ser. No. 464,831 assigned to the assignee of the instant invention concerns apparatus which both floatingly supports a moving web and maintains the web in a substantially straight path as it travels through the dryer. The apparatus includes a steerable air bar assembly whereby air bars are adjusted or steered with respect to the running web so as to correct any undesired web weave or web shift.

In order to accommodate web weave and shift, the web slot both at the inlet and outlet of the dryer is appropriately dimensioned, so that if and when the web moves from its desired location, physical contact with the borders defining the slot is avoided. However, since the dimensions necessary to so accommodate such web movement are larger than would be necessary were the web to remain in its desired location, substantial infiltration of ambient air into the dryer results. Since any air taken into the web slot would eventually need to be exhausted at temperatures as high as about 350° F., fuel wastes become substantial. For example, in a dryer operating at a negative pressure of 0.2" w.c., A 10"×40" web slot would have an air flow of 4,172 cubic feet per minute. At the same negative pressure, if the web slot were only 1"×40", the flow would be reduced to 497 cubic feet per minute. The one inch slot would use approximately 0.15 million btu's/hr, while the ten inch slot would use approximately 1.5 million btu's/hr, a 10 fold increase in fuel usage.

In addition, web slot infiltration results in condensate build-up on the air bars in the dryer that are closest to the web slots. This build-up occurs when the cooler ambient room temperature air outside of the dryer enclosure is drawn into the web slots and meets the hot printing ink oil solvent laden all inside the dryer, thus dropping the temperature to the condensation point. Too much build-up causes air bar nozzles to become plugged, which results in adverse floatation problems. Drawing too much air through the web slot can also cause floatation stability problems.

It is therefore an object of the present invention to reduce infiltration through a web slot in drying apparatus.

SUMMARY OF THE INVENTION

The problems of the prior art have been solved by the present invention, which provides a moveable web slot to reduce infiltration into the dryer proper. In particular, the present invention relates to a moveable or rotatable web slot which moves according to the position of the web as it moves through the dryer. The invention further relates to a dryer comprising one or more moveable web slots.

Although it will be understood by those skilled in the art that the adjustable web slot assembly of the present invention can be used independently, in a preferred embodiment, the moveable web slot is in mechanical communication with a steerable air bar steering mechanism. As the steering mechanism operates to steer the web, the moveable web slot or slots is caused to move to a position corresponding to the changing position of the web. In this way, web contact with the boundaries of the web slot is avoided without requiring over-sized web slots.

DETAILED DESCRIPTION OF THE INVENTION

Figure 1:
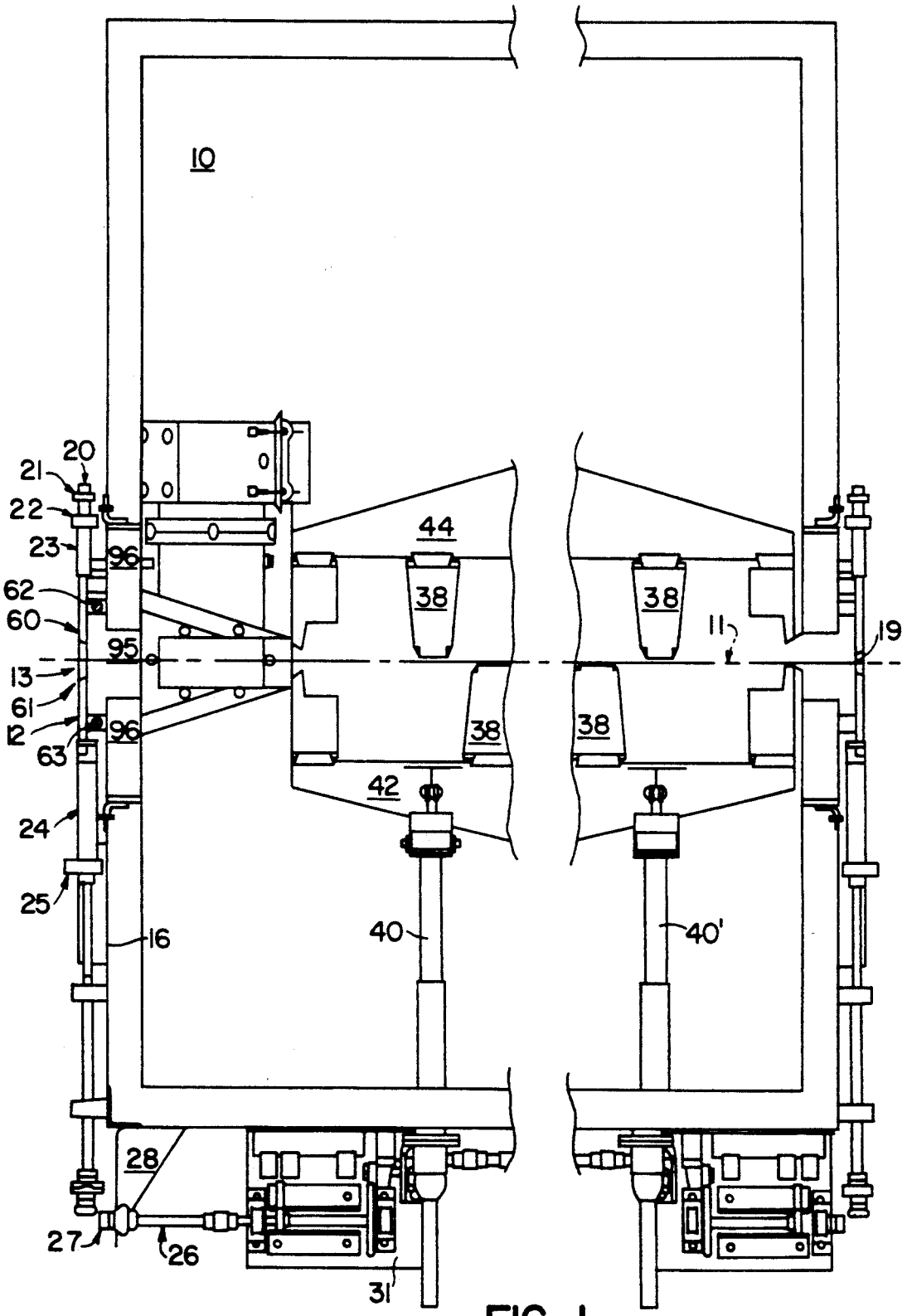
FIG. 1 is a front cross-sectional view of a dryer having an adjustable web inlet slot and an adjustable web outlet slot in accordance with the present invention.
Figure 8:
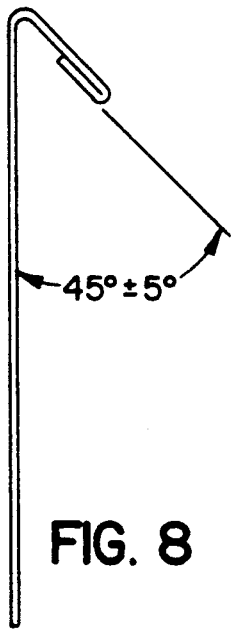
FIG. 8 is a side view of the "J" seal for use in an adjustable web slot in accordance with the present invention.

Turning now to FIG. 1, there is shown a dryer 10 having a plurality of air bars 38 affixed to upper and lower headers 44 and 42, respectively. Air issuing from the air bars 38 floatingly guides web 11 through the dryer while drying any solvent, etc. on the web surface(s). The upper and lower air bars are transversely positioned across the web, and are in staggered, spaced relation along the web with respect to each other such that the floating web assumes a substantially sinusoidal path. Web 11 is shown being guided through a web slot 13 having a pre-set constant or substantially constant gap of approximately one inch and being defined by adjustable "J" seals 60, 61 (FIGS. 8 and 9), through slot 95 defined by web slot housing frame 96, into the interior of the dryer, and out through web exit slot 19. For convenience, only the web entry slot will be referred to; however it should be understood that similar features and functions are typical to web exit slot 19 as well.

Vertical push rod 24 with attached guide block 25 guided in guide rail 98 (FIG. 6) is generally shown and is affixed to the lower face plate 16 of dryer 10 by suitable means. Upper spring loaded guide rod 20 is associated with a collar clamp 21, bushing 22 and compression spring 23 for purposes described hereinbelow with respect to FIG. 2. Vertical push rod 24 is driven by drive shaft 26 through miter gears 27 supported by bracket 28. Drive shaft 26 is also coupled to screw jack 40 through reduction gears/header stop assembly 31. The jack 40 driven by motor 32 is coupled to the corresponding jack 40' for web slot 19 by shaft 26a having pillow block bearings 30 (FIG. 7), and functions to adjust the position of the steerable air bar assembly. The push rods disengage once the headers move greater than about one inch so that the adjustable web slot assembly remains stationary during web up, etc.

Figure 3:
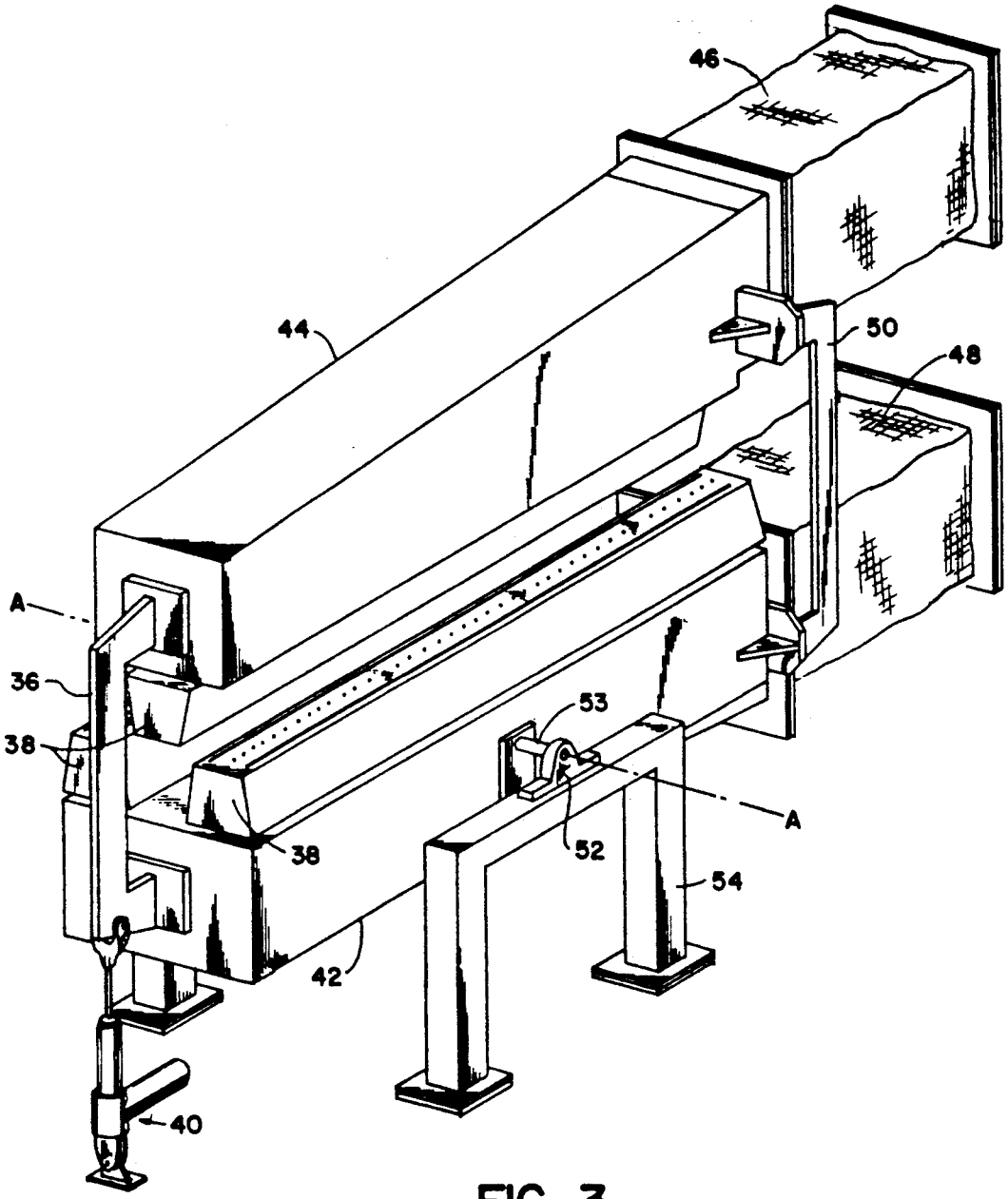
FIG. 3 is a perspective view of a steerable air bar assembly that can be used in conjunction with the adjustable web slot of the instant invention.
Figure 4:
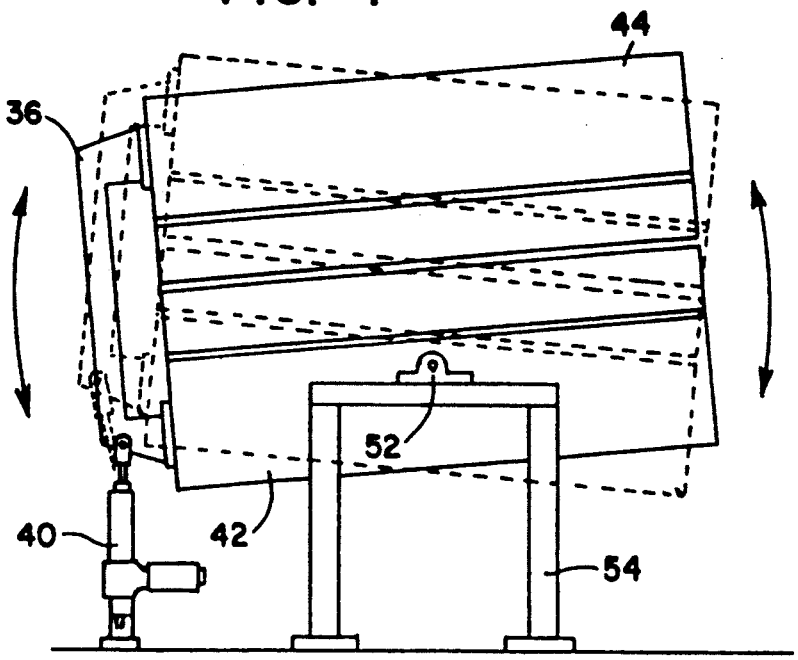
FIG. 4 is a multi-position schematic view of one embodiment of a steerable air bar assembly that can be used in conjunction with the adjustable web slot of the instant invention.

With particular reference to FIG. 3, there is shown an example of a steerable air bar assembly which for purposes of illustration, includes three adjustable air bars 38 such as Coanda air bars supported by and in air-receiving communication with upper and lower headers 44 and 42, respectively. (The combinations of the two lower air bars and the lower header, and the single upper air bar and upper header 44 will hereinafter be referred to as the lower and upper air bar/header assemblies, respectively). In the embodiment shown, the upper and lower air bar/header assemblies are maintained in opposing spaced relation by spacer means comprising header carriage 36 and support member 50, and upper and lower headers 44 and 42 are each sealingly joined at one of their respective ends to upper and lower flexible air ducts 46 and 48 (additional ducting not shown). Header carriage 36 is connected at its lower edge to screw jack 40, and the lower air bar/header assembly engages on each side a pivot bearing 52, supported by a support member 54, by means of a connecting rod 53. Thus, when screw jack 40 is adjusted up or down, the ends of both air bar/header assemblies adjacent screw jack 40 will correspondingly move up or down, as shown schematically in FIG. 4. The angular adjustment of the air bar/header assemblies is thus facilitated by a pivoting support means, comprising pivot bearings 52 and connecting rods 53, and an angular adjustment means, comprising screw jack 40, which allow the air bar/header assemblies to be rotated about an axis A which is substantially parallel to the longitudinal centerline of the running web, while being prevented from translational or rotational movement in any other plane. The presence of header carriages 36 and 50 and support member 54, allows this movement to take place without the spatial relationship among the air bars being altered. This simultaneous adjustment of the orientation of both the upper and lower air bars is further facilitated by flexible air ducts 46 and 48, which allow a sealing relationship to be maintained between upper and lower headers 44 and 42 and the air supply, regardless of the position of the headers. One type of flexible air duct which may be used in the invention is described in U.S. Pat. No. 4,480,859, the disclosure of which is incorporated herein by reference. The adjustment of the orientation of the surfaces of the air bars with respect to the web may be accomplished manually by the dryer operator, by computer, or by other suitable means.

The position of the edge of the running web can be monitored at one or more locations within the dryer, using conventional sensing means, such as fiber optics. Based on these measurements of the position of the web edge, the steerable air bars are adjusted, periodically or continuously, such that they provide a force which adjusts the web into a substantially straight path. Alternatively, instead of sensing the position of the web as it travels through the dryer, computer-generated data may be used to predetermine the desired web path and the anticipated web position, and to compare these two positions. The steerable air bars may then be adjusted based upon that comparison to adjust the position of the web to the desired web path.

Figure 7:
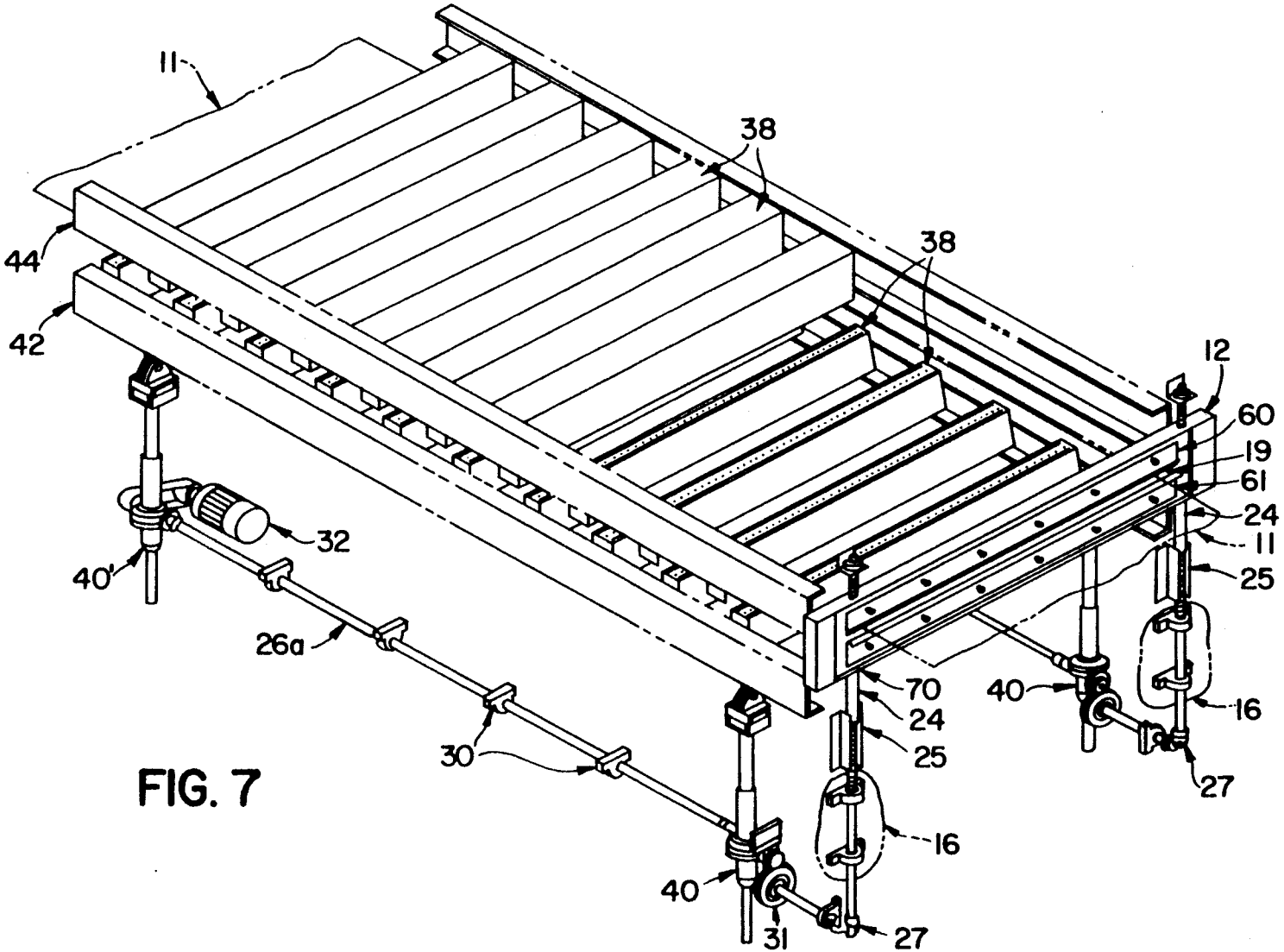
FIG. 7 is a perspective view of one embodiment of a dryer in accordance with the present invention.
Figure 10:
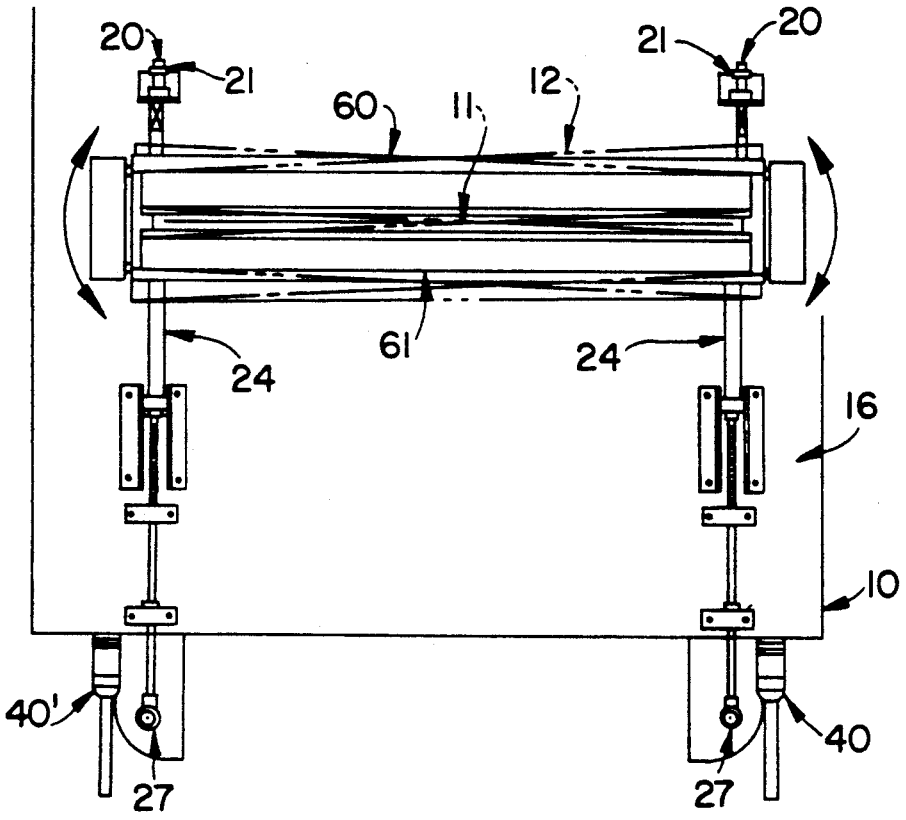
FIG. 10 is a multi-position schematic view of one embodiment of a steerable air bar assembly that can be used in conjunction with the adjustable web slot of the present invention.

In an alternative embodiment, the upper header system 44 in FIG. 7 (where all numerals correspond to those previously described) is stationary. The lower header system 42 is supported by screw jacks 40 located on each side of the web centerline. The screw jacks at opposite sides of the web centerline move in opposite directions with respect to each other when energized. This causes lower header system 42 to pivot about its centerline, as shown in FIG. 10.

Figure 2:
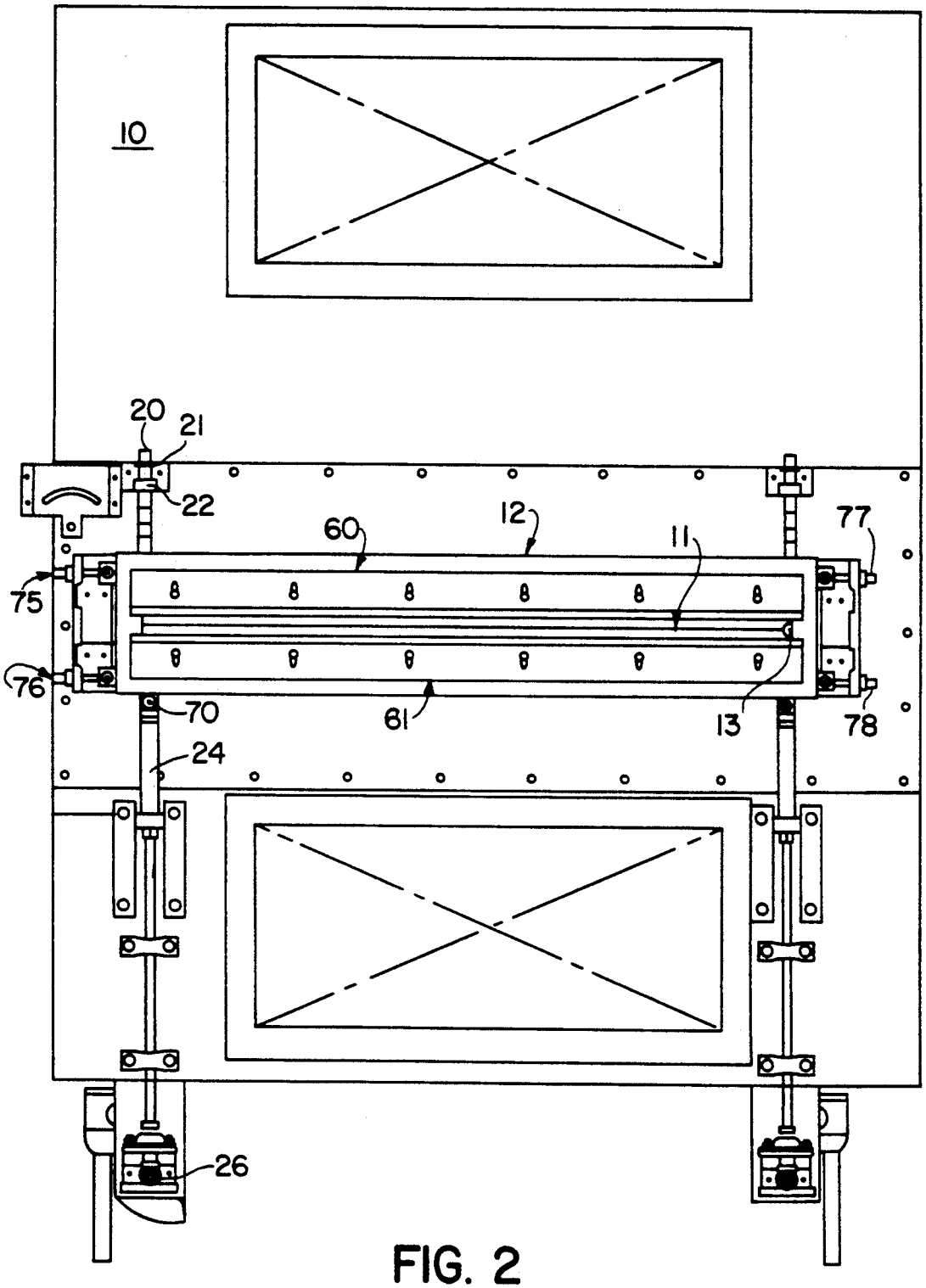
FIG. 2 is a web entry-side view of a dryer having an adjustable web slot in accordance with the present invention.
Figure 6:
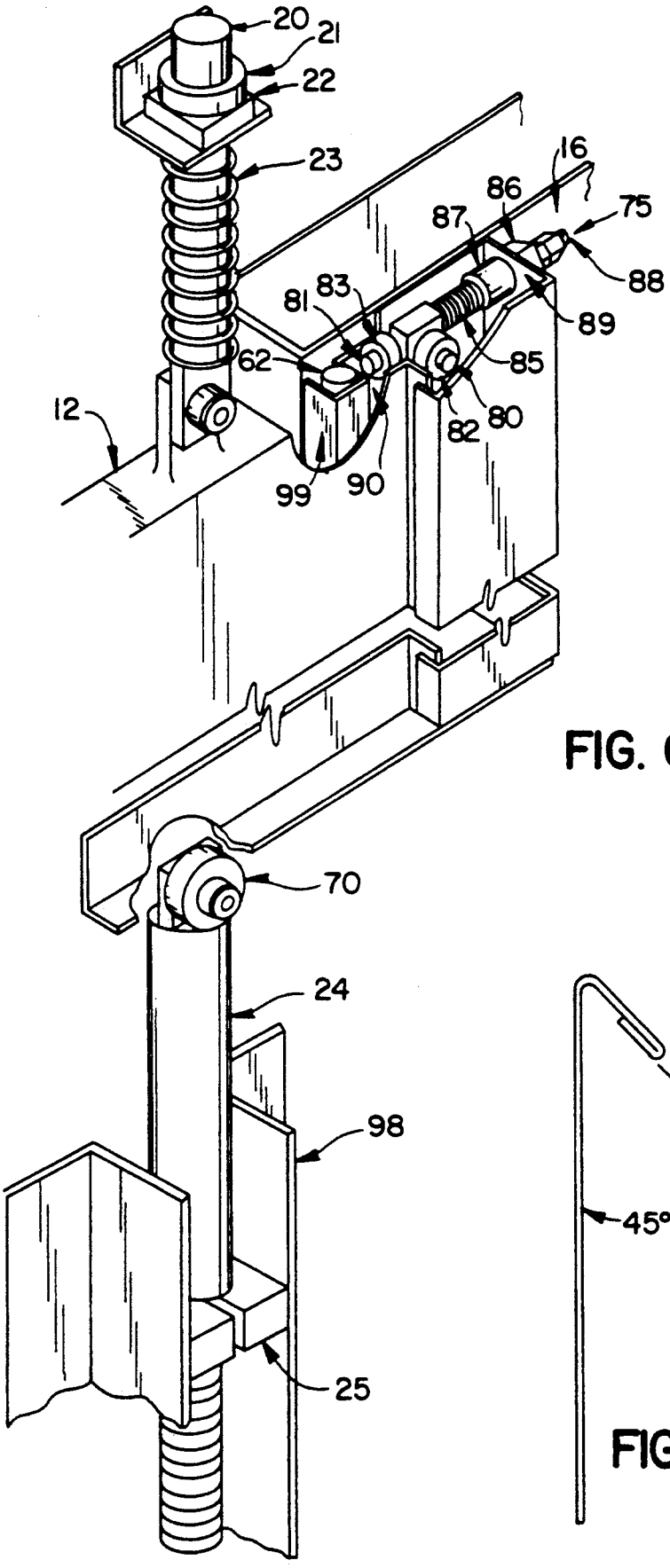
FIG. 6 is a perspective view of the vertical push rod assembly in accordance with the present invention.
Figure 9:
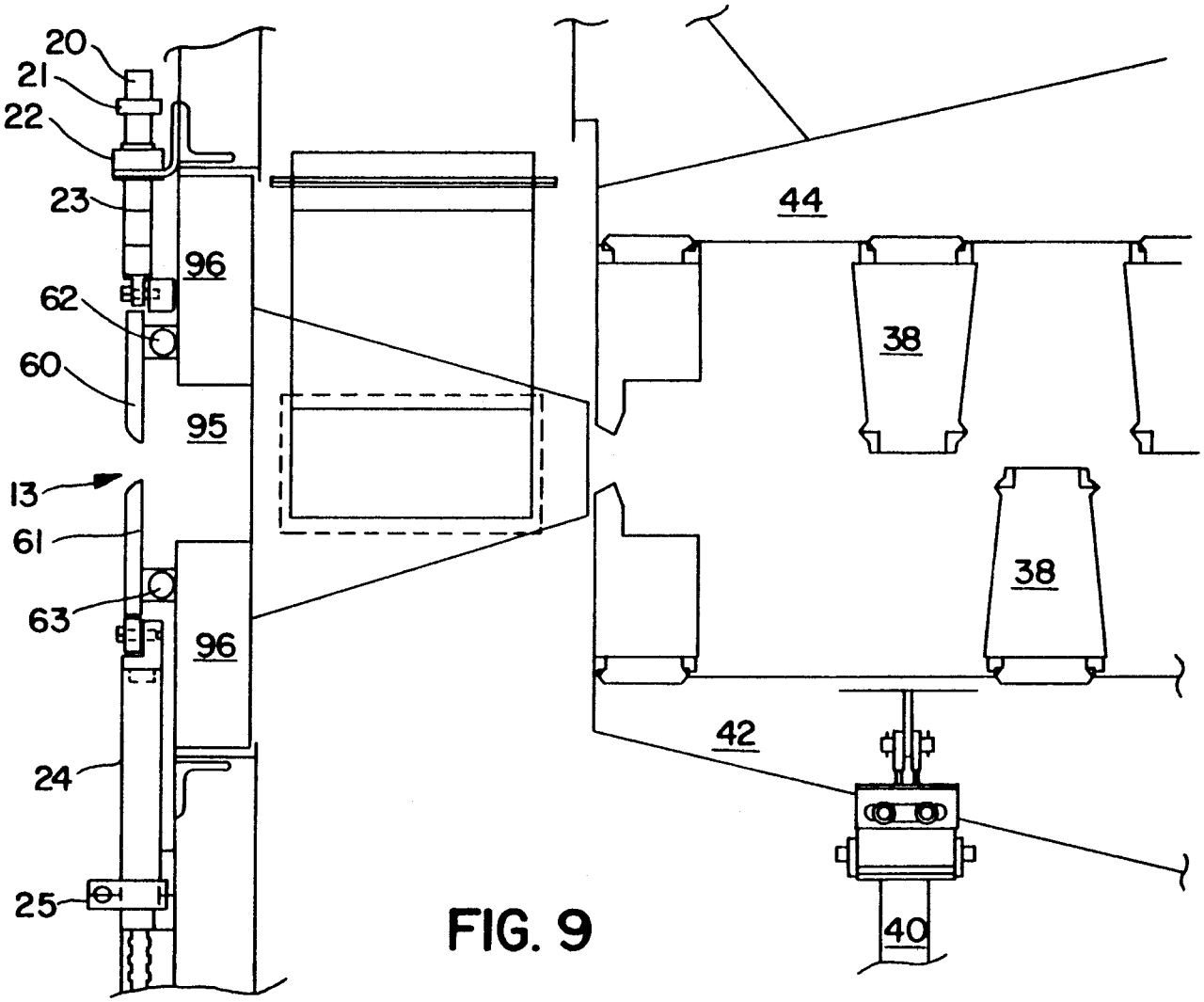
FIG. 9 is an exploded side view of the adjustable web slot in accordance with the present invention.

Turning now to FIG. 2, where all numerals correspond to those previously described, there is shown the web entry side of dryer 10 having a moveable web slot sealing frame 12 with web 11 passing through the slot 13. Adjustable "J" seals 60, 61 define slot 13, and are affixed to the frame 12. As best seen in FIG. 9, where all numerals correspond to those previously described, the "J" seals minimize the web slot opening in order to minimize the web slot infiltration of ambient air into the dryer through the web slot opening. In addition, the "J" shape of the seal is such that a snag free non-sharp sealing edge is created at the entry and/or exit of the dryer web slot. Those skilled in the art will recognize that other shapes could be used to achieve similar functions, such as "L" shaped seals where the longer arm is in the direction of web travel. Sealing gaskets 62, 63, such as Teflon-coated gaskets in gasket retention channel 99 welded to frame 12, seal frame 12 against the face of the dryer, as shown in FIGS. 1, 6 and 9. The web slot sealing frame 12, adjustable "J" seals 60, 61 and sealing gaskets 62, 63 are considered to be the moveable web slot assembly. The sealing frame 12, which is spring loaded which enables it to float in a substantially vertical direction, sits on push rod roller 70, which functions to move the frame up and down upon being driven by drive shaft 26. As the web slot assembly is pushed upward, upper spring loaded guide rod 20 maintains spring pressure against the frame 12 and guides the web slot assembly. A collar clamp 21 and bushing 22 are located on the guide rod 20 so that as vertical push rod 24 and push rod roller 70 is lowered, the collar clamp 21 meets bushing 22 and provides a stop.

Figure 5:
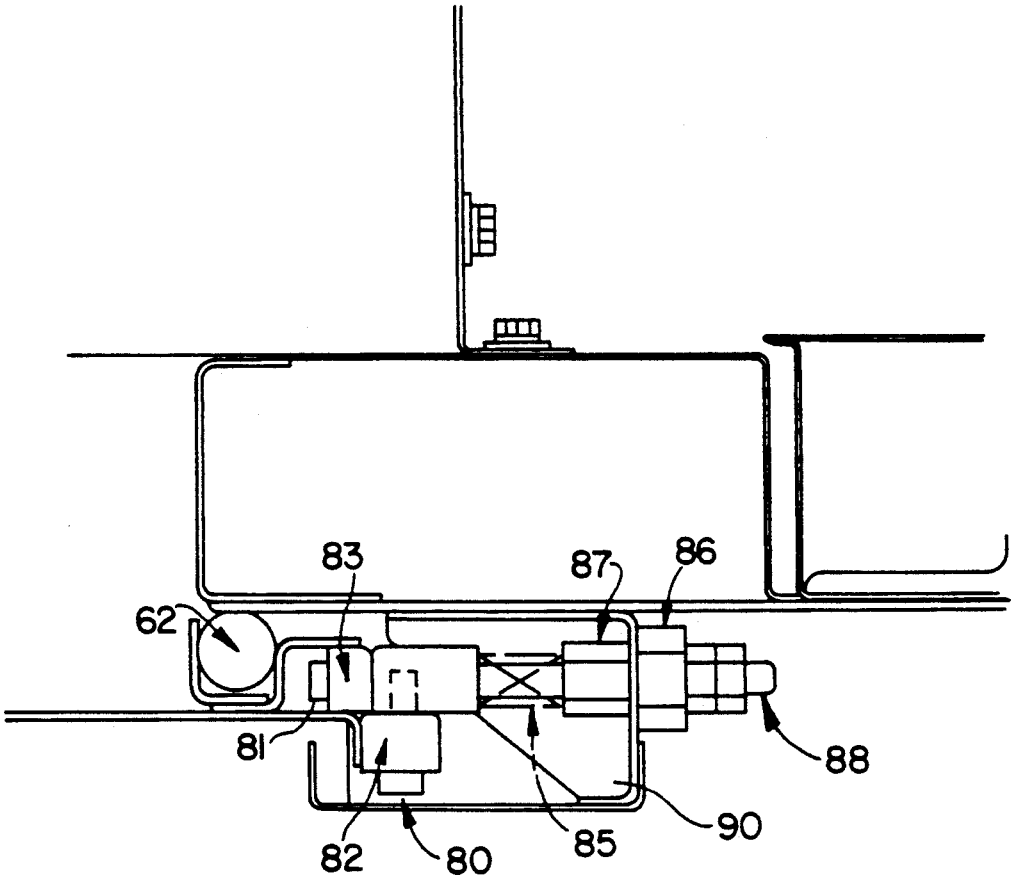
FIG. 5 is a top cross-sectional view of a vertical tracking spring loaded guide roller assembly in accordance with the present invention.

Substantial vertical alignment of the moveable web slot assembly is maintained by vertical tracking spring loaded guide roller assemblies 75, 76, 77 and 78 (FIGS. 2, 5 and 6). Reference will now be made to vertical tracking spring loaded guide roller assembly 75, although it will be understood that guide roller assembly 75 is typical of assemblies 76, 77 and 78 as well. Assembly 75 includes three rollers with bearings, or cam followers. A bolt head 80 secures one cam follower 82. Substantially perpendicular thereto is a second bolt head 81 and cam follower 83. A third bolt head and cam follower is positioned behind the second and is therefore not visible in FIG. 5. The cam followers are located in a channel position between the dryer front and the web slot sealing frame 12. The second and third cam followers are spring loaded with compression spring 85 (compression spring for the third cam follower not shown). Nut 86 and bushing 87 are fitted on spring loaded stud 88 between slotted bracket 89, such that adjustment of nut 86 adjusts the channel 90 to maintain a tight seal against the dryer.

As the steerable air bar assembly and, in particular, screw jacks operate to steer the web, drive shaft 26 drives push rod 24 so that the web slot assembly moves in unison with the web steering achieved by the steerable air bar header system. Thus, as the steerable air bar header system corrects or prevents web weave and/or web shift, a corresponding shifting of the web slot assembly (e.g., dryer operator side to dryer gear side) is achieved in order to accommodate the new position of the web without altering the actual dimensions of the web slot.

Having thus described the preferred embodiment of the present invention, those skilled in the art will understand that various modifications can be made without departing from the spirit and scope of the invention. For example, although the moveable web slot has been described by way of illustration as functioning in conjunction with a steerable air bar assembly, the instant invention can be used in any situation where web slot movement is desirable.

What is claimed is:

1. Drying apparatus for floatingly drying a running web, said apparatus comprising a dryer having a web inlet slot and a web outlet slot wherein at least one of said slots is defined by upper and lower web slot sealing frame means defining therebetween a slot of substantially constant dimensions through which said web floatingly runs, and means for moving said upper and lower web slot sealing frame means in response to movement of said web.

2. The drying apparatus of claim 1 wherein said upper and lower web slot sealing frame means comprises J seals.

3. The drying apparatus of claim 1 wherein said means for moving said upper and lower web slot sealing frame means is coupled to web steering means.

4. The drying apparatus of claim 1 wherein said means for moving said upper and lower web slot sealing frame means comprises a plurality of vertical push rods which support said lower web slot sealing frame.

5. The drying apparatus of claim 4 wherein said plurality of vertical push rods are coupled to web steering means.

6. The drying apparatus of claim 3 wherein said drying apparatus further comprises an air bar header assembly comprising a plurality of upper air bars positioned above said web and a plurality of lower air bars positioned below said web for floatingly drying said running web, and upper and lower headers in air flow communication with said upper and lower air bars, and wherein said web steering means comprises means coupled to said air bar header assembly for altering the orientation of one or more of said air bars with respect to said web.

7. The drying apparatus of claim 6 wherein said web steering means is coupled to said lower header.

8. The drying apparatus of claim 6 wherein said web steering means is coupled to said upper header.

9. The drying apparatus of claim 6 wherein said means coupled to said air bar header assembly comprises a plurality of jacks.

10. The drying apparatus of claim 1, further comprising means for guiding said upper and lower web slot sealing frame means.

11. The drying apparatus of claim 10, wherein said means for guiding said upper and lower web slot sealing frame means comprises a plurality of spring loaded guide rods affixed to said upper web slot sealing frame means.

12. The drying apparatus of claim 10, wherein said means for guiding said upper and lower web slot sealing frame means comprises a plurality of vertical tracking spring loaded guide roller assemblies.

13. A method of floatingly drying a running web through drying apparatus having a web inlet slot and a web outlet slot, each said slot being of substantially constant dimension, comprising:

a. driving said web through said web inlet slot into said apparatus;

b. floatingly supporting said web on a cushion of air provided by a plurality of air bars positioned in said drying apparatus above and below said web;

c. steering said web in a substantially straight sinusoidal path in said drying apparatus by adjusting the orientation of at least one of said air bars with respect to said web; and d. moving said web inlet slot in response to the movement of the steered web.

14. A method according to claim 13, further comprising moving said web outlet slot in response to the movement of the steered web.

15. A method according to claim 13, wherein prior to step c, the position of the web is determined and compared to a predetermined set point position so that the steering in step c is carried out to adjust the position of the web back to said set point position.

16. A method according to claim 15 wherein the position of the web is determined by sensing means.

* * * * *